US010766585B1

(12) United States Patent
Holland

(10) Patent No.: US 10,766,585 B1
(45) Date of Patent: Sep. 8, 2020

(54) METHOD FOR FILLING A NAUTICAL HYDRAULIC STEERING SYSTEM

(71) Applicant: Outboard Specialty Tools LLC, Charleston, SC (US)

(72) Inventor: Tyler Holland, Charleston, SC (US)

(73) Assignee: Outboard Specialty Tools, LLC, Charleston, SC (US)

( * ) Notice: Subject to any disclaimer, the term of this patent is extended or adjusted under 35 U.S.C. 154(b) by 0 days.

(21) Appl. No.: 16/360,689

(22) Filed: Mar. 21, 2019

(51) Int. Cl.

| | |
|---|---|
| ***B63H 25/04*** | (2006.01) |
| ***B63H 25/10*** | (2006.01) |
| ***B63H 3/08*** | (2006.01) |
| ***B63H 25/30*** | (2006.01) |

(52) U.S. Cl.
CPC ..... *B63H 3/08* (2013.01); *B63H 25/30* (2013.01); *B63H 2003/088* (2013.01)

(58) Field of Classification Search
CPC ..... B63H 3/08; B63H 2003/088; B63H 25/30
USPC ..... 114/144 R, 144 A, 150; 440/61 S, 61 A, 440/61 C
See application file for complete search history.

(56) References Cited

U.S. PATENT DOCUMENTS

| | | | | |
|---|---|---|---|---|
| 5,404,961 A * | 4/1995 | Huber | B63H 25/30 | 114/144 R |
| 6,796,856 B2 * | 9/2004 | Roycroft | B60F 3/0007 | 114/150 |
| 8,133,084 B2 * | 3/2012 | Murai | B63H 21/265 | 440/61 D |

* cited by examiner

*Primary Examiner* — Daniel V Venne
(74) *Attorney, Agent, or Firm* — Zwerner Law, LLC; Morgan Malino

(57) ABSTRACT

A method to fill hydraulic oil in hydraulic steering systems for boats. The method uses a closed system to reduce mess and waste, but does not require power and can be performed by a single operator. A bleed lock is secured to a ram's bleeders and hydraulic oil fed to a helm. By rotating a boat's steering wheel and moving the motor, air will flow out of the system into the bottle and hydraulic oil will flow into the system.

16 Claims, 6 Drawing Sheets

METHOD FOR FILLING A NAUTICAL HYDRAULIC STEERING SYSTEM

FIELD OF THE INVENTION

The present invention relates to hydraulic steering systems for boats.

BRIEF DISCUSSION OF RELATED ART

Hydraulic steering systems offer larger or high-powered vessels a smooth, lightweight feel when turning the steering wheel.

Hydraulic steering is made up of three components: a pump with a reservoir for hydraulic oil, a ram that connects to a rudder or outboard engine, and connecting hoses that transmit pressurized fluid from the steering pump to a steering piston rod. Turning the steering wheel in either direction pumps oil through the lines to the ram, which in turn pulls or pushes the rudder, outboard, or sterndrive in the desired direction.

The simplest example of hydraulic steering is found on small powerboats powered by single outboard or multiple engines linked by a tie bar. On a small boat, a compact hydraulic pump with integral hydraulic-fluid reservoir located at the steering wheel uses hoses to connect to a steering ram at a transom, which turns the outboard(s) as one turns the steering wheel. Steering systems get progressively more complicated on larger boats with multiple helms, autopilots, and power steering, but the basics are much the same.

The hydraulic oil will typically be flushed and replaced every five years or earlier if the hydraulic steering oil contains dirt or is otherwise contaminated. Additionally, small leaks are common (hydraulic oil does not evaporate and is not consumed by use, so low levels of hydraulic oil are typically due to dry rotted or ruptured seals causing leaks), requiring additional hydraulic oil be added even when a complete flush is unnecessary.

Those individuals having ordinary skill in the art use one of only two methods to add hydraulic oil to steering systems. The first is a manual process that requires two people and consists of five steps: (1) the first person attaches a bottle of hydraulic oil to a filler tube, attaches the filler tube to the helm, turns the bottle upside down and pokes a hole in the bottom of the bottle (and holds the bottle upside down throughout the remaining steps of the process) in order to fill the pump full of hydraulic oil, (2) the first person then turns the steering wheel, making many revolutions to one side and then the second person opens the corresponding bleeder on the hydraulic steering cylinder, (3) then, while the first person turns the steering wheel in the opposite direction, the second person holds the cylinder body with their hand and, when air-free hydraulic oil streams out of the bleeder, closes the bleeder and lets go of the cylinder body, (4) the first person continues to turn the steering wheel in the same direction until it stops, and the second person then opens the other bleeder, and (5) both people repeat step 3. The manual process cannot be done alone and is messy, requiring a stream of hydraulic oil to leave the bleeder into (hopefully) an appropriately placed bucket.

Alternatively, there exists powered devices, such as the SeaStar® Power Purge and Power Purge Jr., which cleanly and quickly fills and purges a hydraulic steering system. After filling the device's reservoir with hydraulic oil, the operator attaches the device's bleed lines and opens both bleeders. The operator then attaches a helm adaptor and installs both of the device's helm hoses into the helm adapter. The system is now completely closed with the bleed lines and the helm hoses both connected to the device's body (unlike the manual process that uses the open bleeders and requires a ventilation hole in the oil bottle). Next the operator attaches the device's power cables to a battery and turns the device on. Once the device's helm hoses are free of air, the operator starts turning the steering wheel all the way in both directions until the device's helm hoses are free of air once again. Next, the operator moves the engine from side to side until the device's helm hoses are once again free of air. The operator then shuts off the system, closes the bleeds and removes the hoses and helm adaptor.

Although the powered device solves many of the issues involved with the manual device, it is expensive, costing about $750 from most online retailers.

There is a need to improve the process of replacing hydraulic oil in steering systems.

BRIEF DESCRIPTION OF THE DRAWINGS

The accompanying drawings illustrate one or more embodiments and/or aspects of the disclosure and, together with the written description, serve to explain the principles of the disclosure. Wherever practicable, like reference numbers are used throughout the drawings to refer to the same or like elements of an embodiment, and wherein.

DETAILED DESCRIPTION

Figure 1:
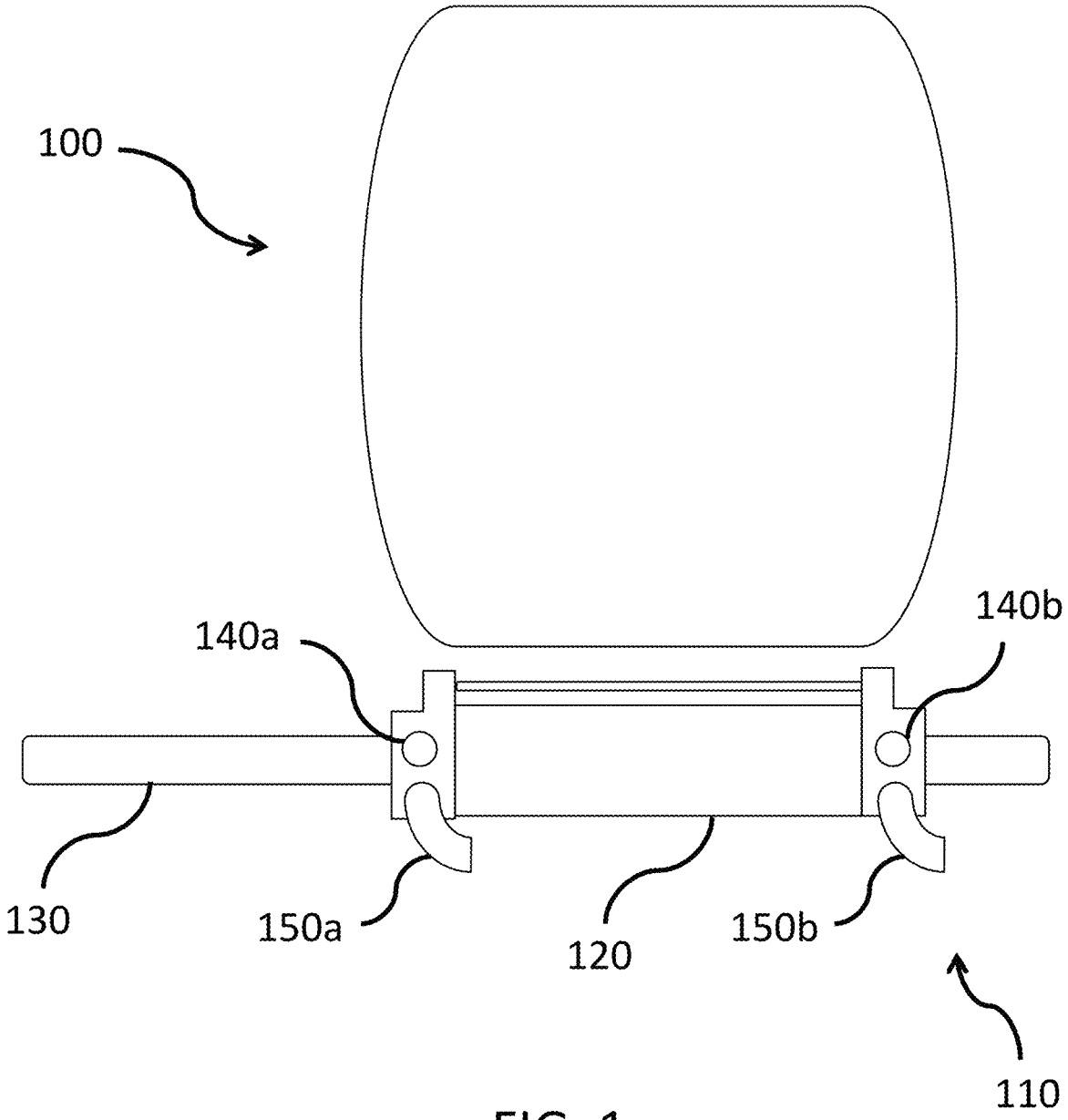
FIG. 1 is a front view of an outboard motor and a ram.

The exemplary embodiments of the present invention are described and illustrated below to encompass methods, systems, and devices related to filling hydraulic oil in nautical steering systems.

Although example embodiments of the present disclosure are explained in detail herein, it is to be understood that other embodiments are contemplated. Accordingly, it is not intended that the present disclosure be limited in its scope to the details of construction and arrangement of components set forth in the following description or illustrated in the drawings. The present to disclosure is capable of other embodiments and of being practiced or carried out in various ways.

It must also be noted that, as used in the specification and the appended claims, the singular forms "a," "an," and "the" include plural referents unless the context clearly dictates otherwise. By "comprising" or "containing" or "including" or "having" is meant that at least the named compound, element, particle, or method step is present in the composition or article or method, but does not exclude the presence of other compounds, materials, particles, method steps, even if the other such compounds, material, particles, method steps have the same function as what is named.

In describing example embodiments, terminology will be resorted to for the sake of clarity. It is intended that each term contemplates its broadest meaning as understood by those skilled in the art and includes all technical equivalents that operate in a similar manner to accomplish a similar purpose. It is also to be understood that the mention of one or more steps of a method does not preclude the presence of additional method steps or intervening method steps between those steps expressly identified. Steps of a method can be performed in a different order than those described herein without departing from the scope of the present disclosure. Similarly, it is also to be understood that the mention of one or more components in a device or system does not preclude the presence of additional components or intervening components between those components expressly identified.

FIG. 1 is a depiction of an outboard motor 100 and a ram 110. The ram 110 includes a cylinder body 120 that slides along a rod 130. The cylinder body includes various adapters, fittings, and equipment including two bleeders 140*a*, 140*b* and two hose fittings for hydraulic hoses 150*a* and 150*b*. The bleeders 140*a*, 140*b* typically have bleed nipple covers that must be removed prior to use.

Figure 2:
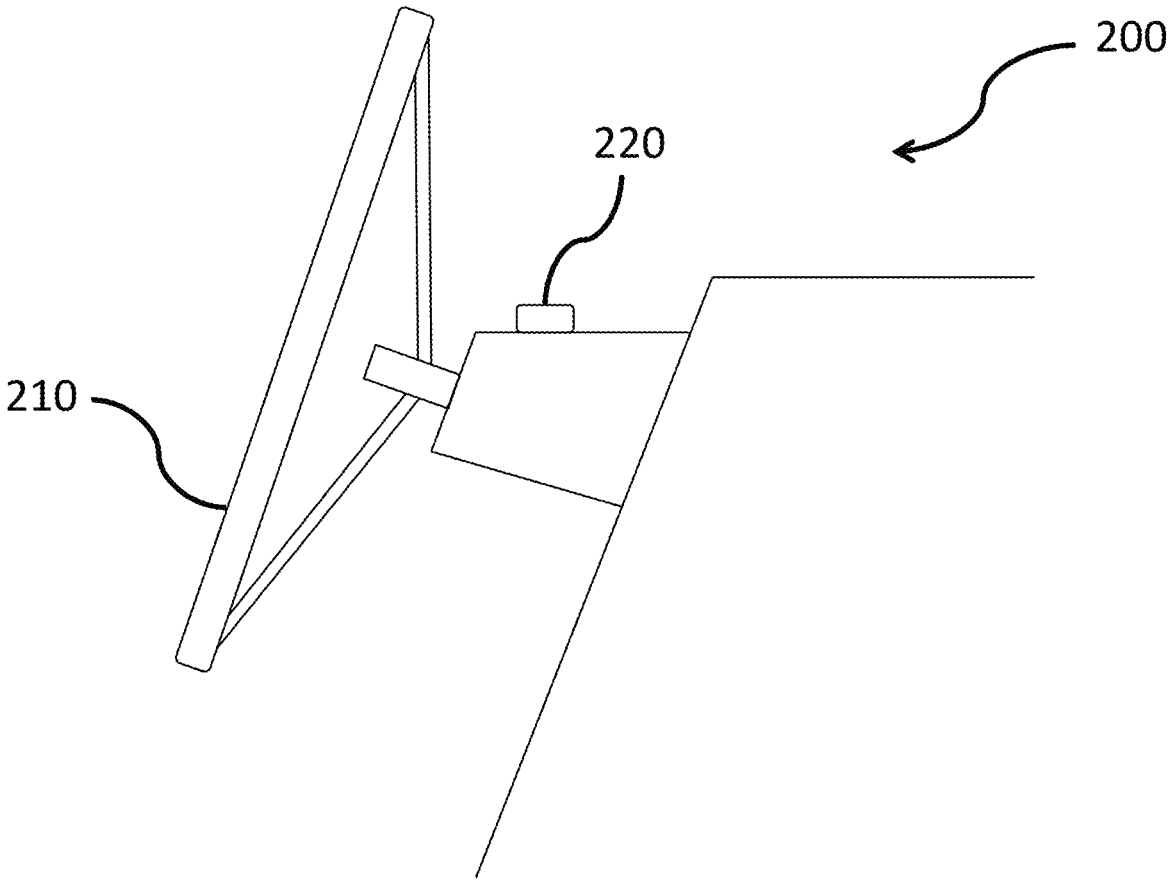
FIG. 2 is a side view of a helm.

FIG. 2 is a depiction of a helm 200 that includes a steering wheel 210 and a helm fill port 220.

Figure 3A:
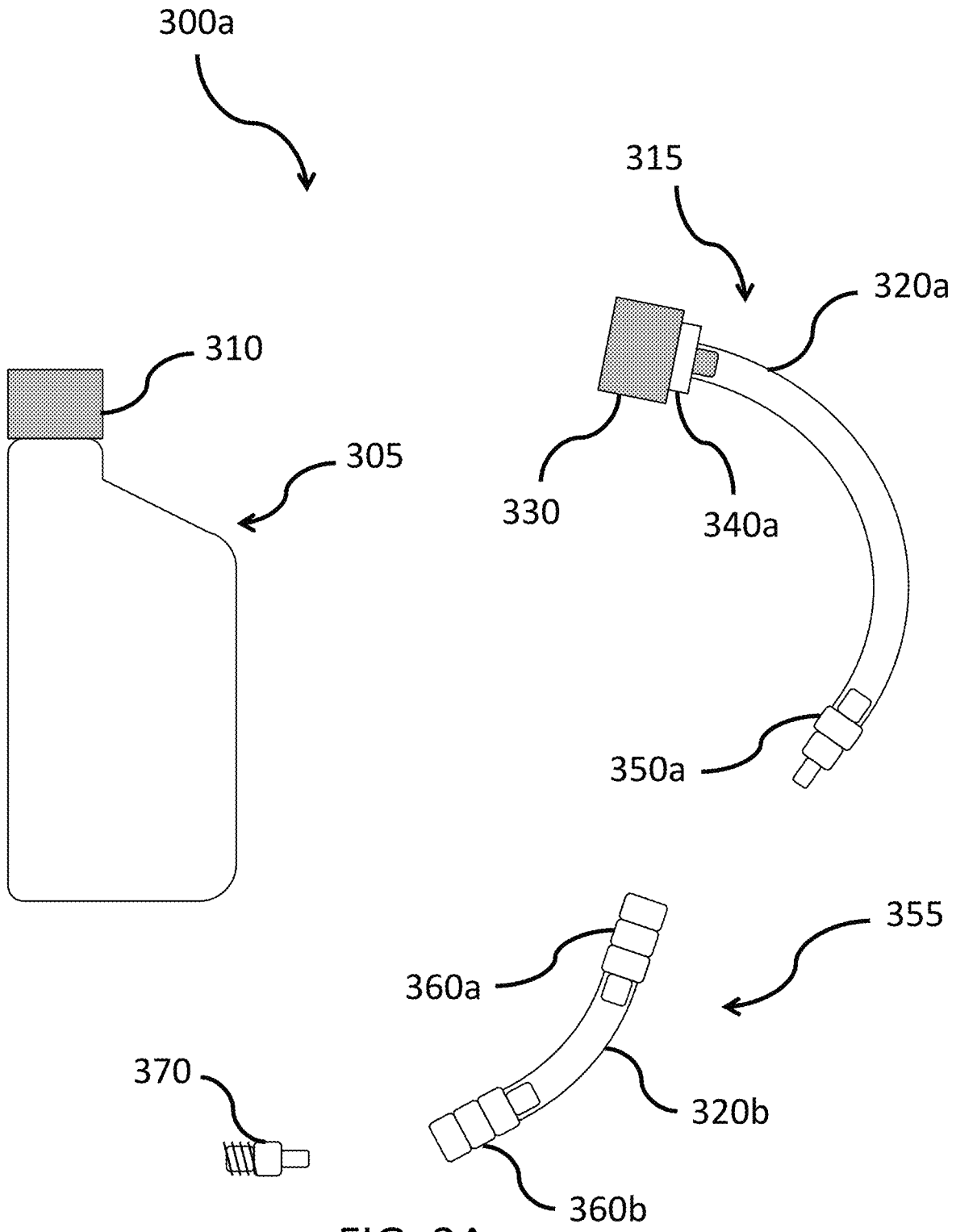
FIG. 3A is a plan view of a first embodiment of various helm-side components of a system for filling hydraulic oil in a nautical steering system.

FIG. 3A is a depiction of a first embodiment of helm-side components 300*a* of the system for filling hydraulic oil from nautical steering systems. The components 300*a* include a bottle of hydraulic oil 305, a bottle attachment 315*a*, a fluid lock 355, and a helm fill port adapter 370. The bottle of hydraulic oil 305 has a lid 310. The bottle attachment 315*a* includes a lid adapter 330, which is secured to the first hose 320*a* by a fastener 340*a* on one end, and a valve 350*a* on the other. The fluid lock 355 is a second hose 320*b* with corresponding valves 360*a*, 360*b* on both sides.

In the depicted embodiment, the lid adapter 330 is an injection-molded lid designed to conform to the dimensions of the bottle lid 310 that includes an 8 mm outside diameter spout in its center. The hoses 320*a*, 320*b*, 320*c* are a transparent polyurethane pneumatic tubing with a 12 mm outside diameter and an 8 mm inside diameter. The fastener 340*a* is an Oetiker® ear clamp, and the valve 350*a* is a male Parker® 21 KA series quick connect coupling with a hose barb. Those skilled in the art will recognize that additional fasteners, such as additional ear clamps, may be used to secure the valve to hose if a secure connection cannot otherwise be made. Similarly, the fastener 340*a* would be unnecessary if the lid adapter 330 had a barbed design on the outside of the spout to lock it in place when inserted into the first hose 320*a* (such as with the hose barb design on the Parker® 21KA series quick connect coupling).

In the depicted embodiment, the second hose 320*b* of the fluid lock 355 is the same material as the first hose 320*a*. The corresponding valves 360*a*, 360*b* are female Parker® 21KA series quick connect couplings with hose barbs.

In the depicted embodiment, the helm fill port adapter 370 is a single female Parker® 21KA series quick connect couplings with a male thread.

Those skilled in the art will recognize that whether a male or female valve is used is arbitrary as long as the bottle attachment 315*a* can connect with the fluid lock 355 and the fluid lock 355 can connect with the helm fill port adapter 370. Although testing suggests that the fluid lock 355 improves usability and prevents spillage, the helm fill port adapter 370 can be coupled directly to the bottle attachment 315*a* if the valve 350*a* of the bottle attachment 315 corresponded to the helm fill port adapter 370 (i.e., in the first embodiment of FIG. 3A, if the valve 350*a* were female).

Figure 3B:
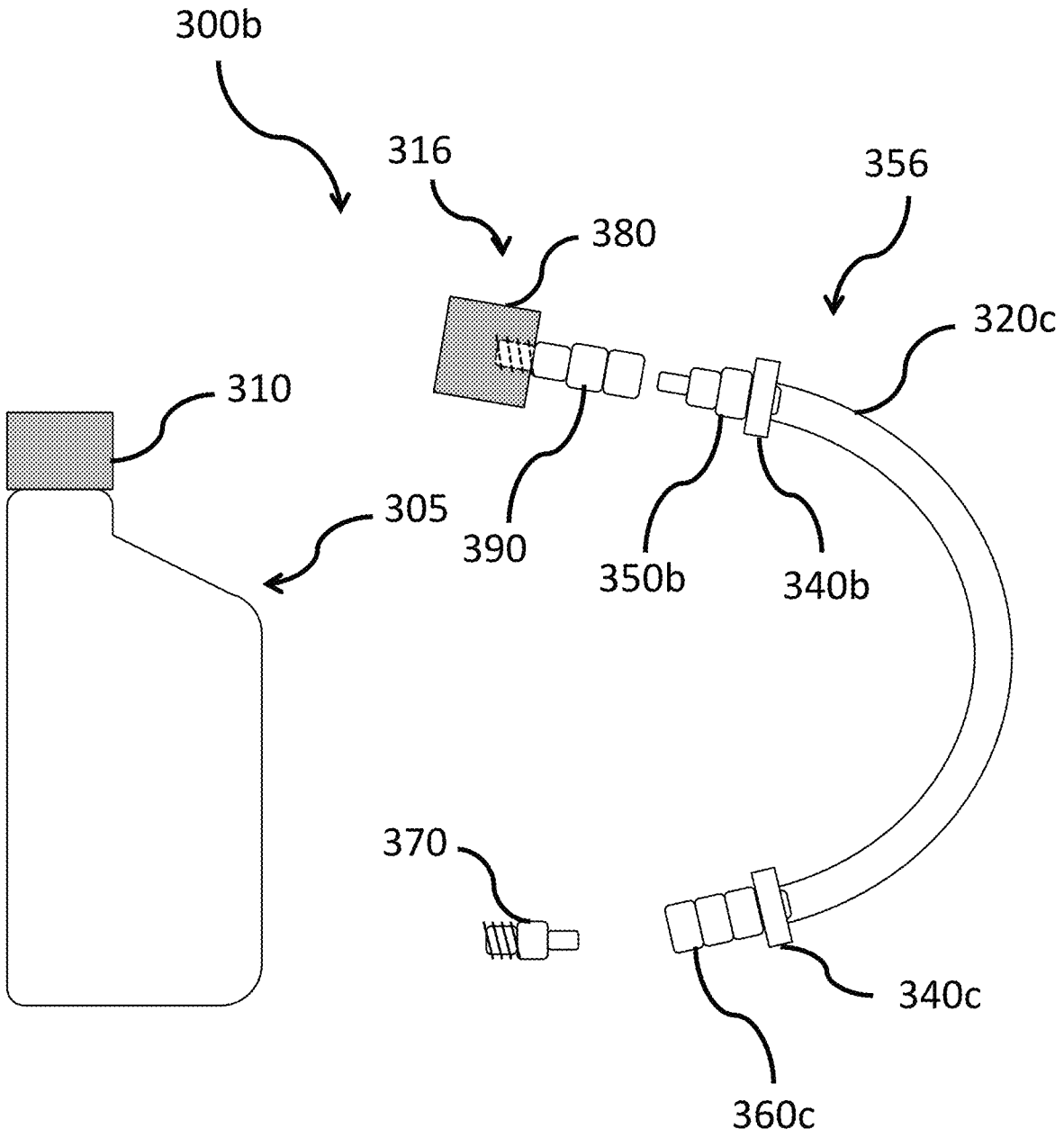
FIG. 3B is a plan view of a second embodiment of various helm-side components of a system for filling hydraulic oil in a nautical steering system.

FIG. 3B is a depiction of a second embodiment of helm-side components 300*b* of the system for filling hydraulic oil from nautical steering systems. The components 300*b* include the bottle of hydraulic oil 305, a bottle attachment 316, a fluid lock 356, and the helm fill port adapter 370.

The bottle attachment 316 can be a cap 380 with a valve 390. The cap 380 is designed to conform to the dimensions of the bottle lid 310. The cap 380 can be made out of brass and have a ⅛" National Pipe Tapered tap. The valve 390 can be a rectus Parker® 21KA female quick connect with a male ⅛" National Pipe Tapered thread. The valve 390 is inserted into the tap of the brass cap 380 (shown in FIG. 3B with dashed lines).

The fluid lock 356 is a hose 320*c* with two valves 350*b*, 360*c*. The hose 320*c* is optimally long enough so that the bottle 305 can rest on top of the helm 200. The valve 350*c* that connects with the bottle attachment 316 can be a male Parker® 21 KA series quick connect coupling that, if it does not include a hose barb (or the hose barb is not sufficient), can be augmented with a fastener 340*b*, such as an ear clamp. Similarly, the distal valve 360*c* can be female Parker® 21 KA series quick connect couplings augmented with a fastener 340*c*, such as an ear clamp.

Figure 4:
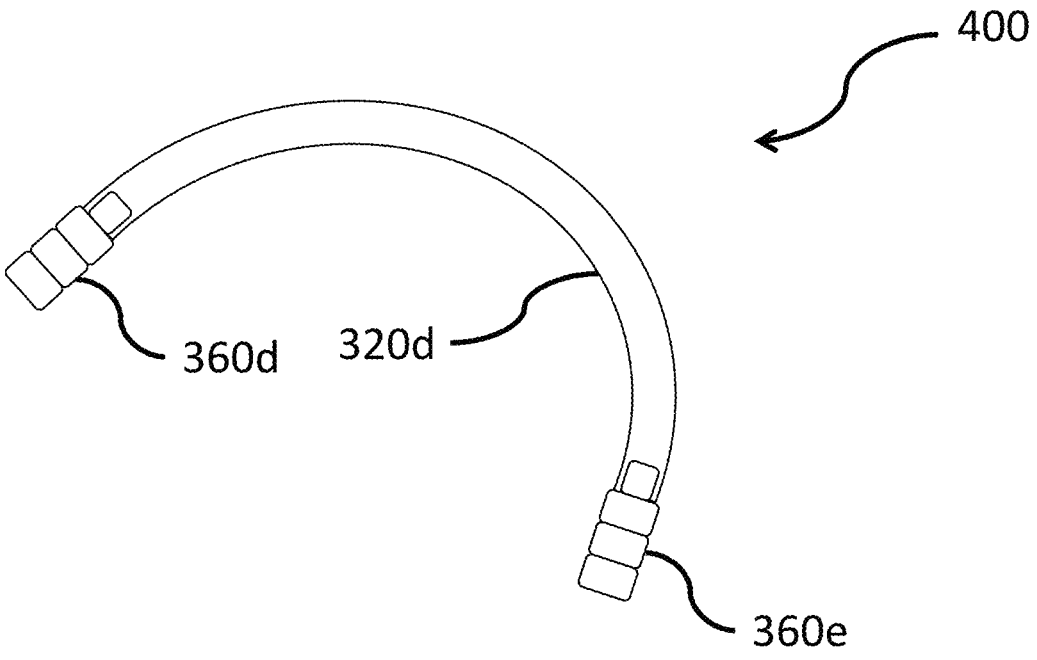
FIG. 4 is a plan view of a bleed lock.

FIG. 4 is a depiction of a bleed lock 400. The bleed lock 400 has only a single fluid path from one end to the other (but the fluid can flow in either direction). In the depicted embodiment the bleed lock 400 uses the same components as the fluid lock 355 from FIG. 3A and includes a hose 320*d*, and two valves 360*d*, 360*e* and the only difference is that the hose 320*d* is significantly longer than the second hose 320*b* (and even the first hose 320*a*).

Figure 5:
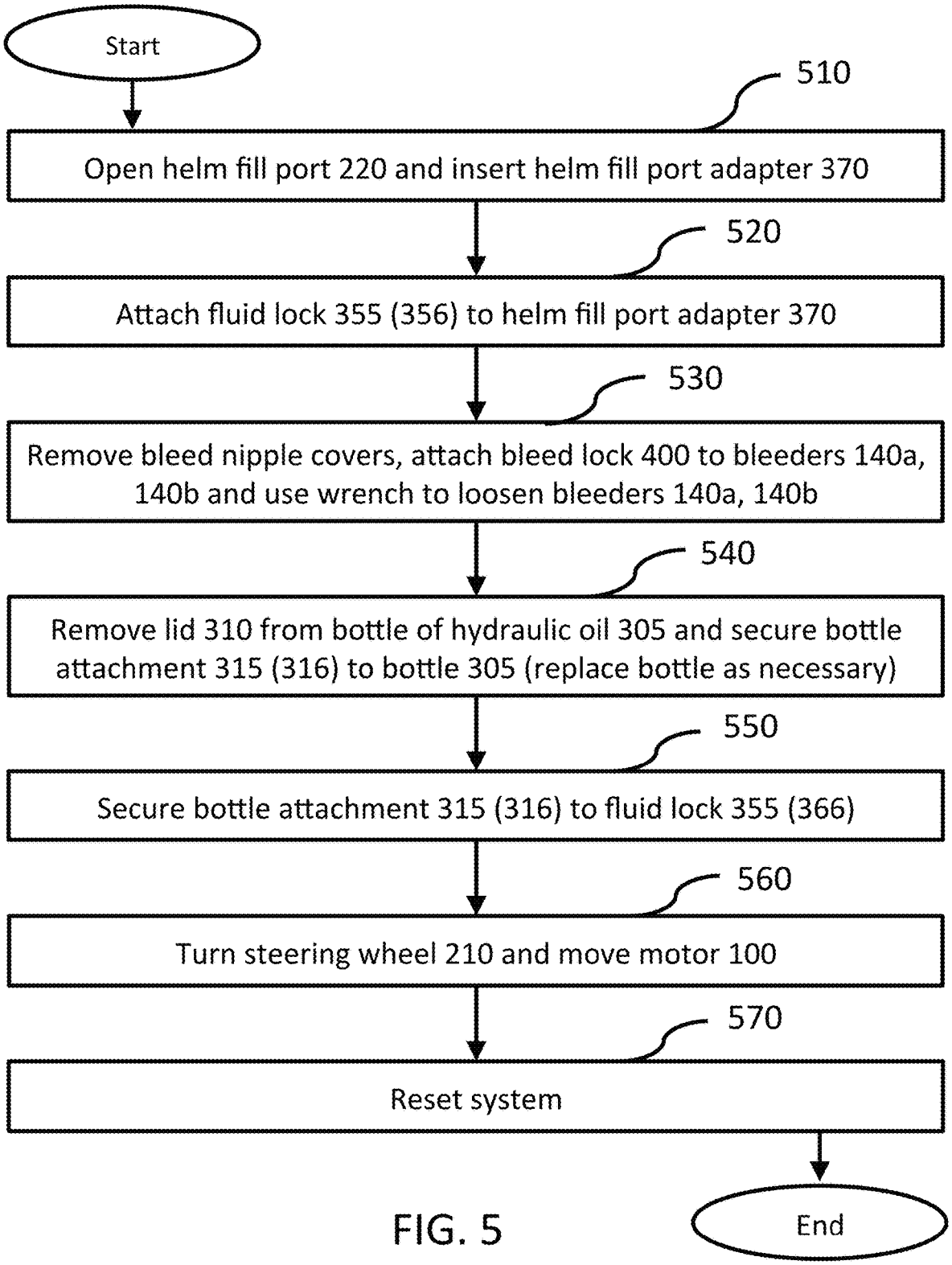
FIG. 5 is a flowchart for filling hydraulic oil in a nautical steering system.

FIG. 5 illustrates an exemplary flowchart for filling hydraulic oil in a nautical steering system.

In step 510, the operator opens the helm fill port 220 and inserts the helm fill port adapter 370.

In step 520, the operator attaches the fluid lock 355 (or fluid lock 356 of FIG. 3B) to the helm fill port adapter 370.

In step 530, the operator removes the bleed nipple covers, attaches the bleed lock 400 to bleeders 140*a*, 140*b* and uses a wrench to loosen the bleeders 140*a*, 140*b*.

In step 540 the operator removes the lid 310 from the bottle of hydraulic oil 305 and secures the bottle attachment 315 (or bottle attachment 316 of FIG. 3B) to the bottle 305. Throughout the process, the operator should check the level in the bottle 305. If the hose 320*a* (or hose 320*c* of FIG. 3B) is transparent, then the operator will be able to see when there is only air in the hose 320*a*, 320*c*, which indicates an empty bottle 305. When empty, the operator can remove the bottle attachment 315 (316) from the empty bottle 305 and secure the bottle attachment 315 (316) to a new, full bottle.

In step 550 the operator secures the bottle attachment 315 (or bottle attachment 316 of FIG. 3B) to the fluid lock 355, 356, turns the bottle 305 upside down and places the bottle 305 higher than the helm fill port 220 so that gravity will pull the hydraulic oil from bottle 305 to the reservoir and draw air into the bottle. The hydraulic steering system is once again a closed system with no ventilation.

In step 560 the operator moves the steering wheel 210 and the motor 100 to move the air out of the system. Optimally, the operator will first move the motor 100 all the way in one direction, then turn the steering wheel 210 about 20 turns in one direction, then reverse and turn the steering wheel 210 about 20 turns in the other direction. If the hose 320*d* of the bleed lock 400 is transparent, then the operator will be able to see when the third hose 320*d* is free of air bubbles and full of hydraulic oil. When this occurs, the operator can move the motor 100 all the way to the other direction. Similarly, if the helm-side hoses 320*a*, 320*b* (or helm side hose 320*c* of FIG. 3B) are transparent, the operator can see when the hoses

320*a*, 320*b* (320*c*) starts having less air bubbles flowing through it. At that point, the operator can reduce the number of turns of the steering wheel 210 in each direction. When the operator feels an air bubble (a sudden lessening of resistance in the steering wheel 210), the operator can reverse direction for one turn before resuming the original direction. Once the hoses 320*a*, 320*b* (320*c*), 320*d* are all free of air bubbles, the operator can push the motor 100 from one side to the other (lock to lock) a few times.

In step 570 the operator will reset the system. In order to prevent spillage, the operator can turn the bottle 305 right-side up and lower the bottle 305. Once air bubbles rise to the end of the fluid lock 355 (or fluid lock 356 of FIG. 3B) opposite the helm fill port adapter 370 the bottle attachment 315 (or bottle attachment 316 of FIG. 3B) can be separated from the fluid lock 355 (356) without spillage. Then the operator can hand-tighten the bleeders 140*a*, 140*b* with a wrench, remove the bleed lock 400, and replace the bleed nipple covers. The operator can remove the fluid lock 355 (356) from the helm fill port adapter 370, remove the helm fill port adapter 370 from the helm fill port 220, and replace the cover of the helm fill port 220.

As previously stated, detailed embodiments of the present invention are disclosed herein; however, it is to be understood that the disclosed embodiments are merely exemplary of the invention that may be embodied in various forms. It will be appreciated that many modifications and other variations stand within the intended scope of this invention as claimed below. Furthermore, the foregoing description of various embodiments does not necessarily imply exclusion. For example, "some" embodiments may include all or part of "other" and "further" embodiments within the scope of this invention. In addition, "a" does not mean "one and only one;" "a" can mean "one and more than one."

Accordingly, that which is intended to be protected by Letters Patent is set forth in the claims and includes all variations and modifications that fall within the spirit and scope of the claim. Notwithstanding the foregoing, the claims described in the Letters Patent have been presented with the intent of avoiding the construction authorized under 35 USC § 112(f). Specifically, regardless of whether a claim has functional language, the scope of such a claim is not intended to, in the words of 25 USC § 112(f), "cover the corresponding structure, material, or acts described in the specification and equivalents thereof." If necessary, and as long as the result is not invalidity, a claim should be to interpreted (which may include disregarding formatting such as line indentations) such that either (i) it is not for a combination or (ii) functional elements encompass structure, material, or acts in support thereof.

What is claimed:

1. A method for filling hydraulic oil in a nautical steering system having a helm with a fill port and a ram with bleeders, the method comprising:

securing a bleed lock to the ram's bleeders, the bleed lock being a fluid conduit with two ends and having valves on both ends, the valves being adapted to connect to the ram's bleeders and the bleed lock making a continuous connection directly between the ram's bleeders system;

connecting a bottle of hydraulic oil to a bottle attachment;

inserting a helm fill port adapter into the helm's fill port;

connecting the bottle attachment to a fluid lock;

connecting the fluid lock to the helm fill port adapter; and filling the helm's fill port with hydraulic oil from the bottle of hydraulic oil.

2. The method of claim 1, wherein the helm includes a steering wheel and the ram is connected to a motor and the method further comprises:

turning the steering wheel; and moving the motor.

3. A method for filling hydraulic oil in a nautical steering system having a helm with a fill port and a ram with bleeders, the method comprising:

securing a bleed lock to the ram's bleeders, the bleed lock having a single fluid path from bleeder to bleeder; and connecting a bottle of hydraulic oil with the helm's fill port;

wherein connecting the bottle of hydraulic oil includes connecting a bottle attachment to the bottle of hydraulic oil, and filling the helm's fill port with hydraulic oil from the container of hydraulic oil.

4. The method of claim 3, wherein once the bleed lock is secured and the bottle of hydraulic oil is connected, the nautical steering system is a closed system.

5. The method of claim 3, wherein once the bleed lock is secured and the bottle of hydraulic oil is connected, there is no ventilation.

6. The method of claim 3, wherein the bleed lock includes a transparent hose having two ends with valves on both ends, the valves being adapted to connect to the ram's bleeders.

7. The method of claim 3, wherein connecting the bottle of hydraulic oil further includes connecting a fluid lock to the bottle attachment.

8. The method of claim 7, wherein connecting the bottle of hydraulic oil further includes:

connecting a helm fill port adapter to the helm's fill port; and connecting the fluid lock to a helm fill port adapter.

9. The method of claim 8, wherein the bottle attachment includes a lid adapter that fits the bottle of hydraulic oil.

10. The method of claim 9, wherein:

the helm fill port adapter includes a first valve;

the fluid lock includes a second and third valve, the second valve adapted to connect with the first valve; and the bottle attachment includes a fourth valve adapted to connect with the third valve.

11. The method of claim 10, wherein the bleed lock, the fluid lock and the bottle attachment all include transparent hoses.

12. The method of claim 11, wherein the bleed lock has two valves, the valves being adapted to connect to the ram's bleeders.

13. The method of claim 3, wherein the helm includes a steering wheel and the ram is connected to a motor and the method further comprises:

turning the steering wheel; and moving the motor.

14. A method for filling hydraulic oil in a nautical steering system having a helm with a fill port and a ram with bleeders, the method comprising:

connecting a bottle of hydraulic oil to a bottle attachment;

inserting a helm fill port adapter into the helm's fill port, wherein the bottle attachment and the helm fill port adapter are connected by a hose;

securing a bleed lock to the ram's bleeders, the bleed lock having two ends with valves on both ends, the valves being adapted to connect to the ram's bleeders and the bleed lock making a continuous connection directly between the ram's bleeders; and filling the helm's fill port with hydraulic oil from the bottle of hydraulic oil.

15. The method of claim 14, wherein the helm includes a steering wheel and the ram and the method further comprises turning the steering wheel.

16. The method of claim 14, wherein the filling of the helm's fill point is accomplished by raising the bottle of hydraulic oil above the helm's fill port, whereby gravity causes the hydraulic oil to flow from the bottle of hydraulic oil into the helm's fill port.

* * * * *